US006807903B2

(12) United States Patent
Anderson

(10) Patent No.: US 6,807,903 B2
(45) Date of Patent: Oct. 26, 2004

(54) TRUSS ASSEMBLY APPARATUS

(75) Inventor: William W. Anderson, Edenton, NC (US)

(73) Assignee: MiTek Holdings, Inc., Chesterfield, MO (US)

( * ) Notice: Subject to any disclaimer, the term of this patent is extended or adjusted under 35 U.S.C. 154(b) by 69 days.

(21) Appl. No.: 10/233,034

(22) Filed: Aug. 30, 2002

(65) Prior Publication Data

US 2004/0040452 A1 Mar. 4, 2004

(51) Int. Cl.[7] ..... B30B 3/02
(52) U.S. Cl. ..... 100/210; 100/913
(58) Field of Search ..... 100/210, 913; 29/428, 432, 798, 897, 897.3, 897.31, 281.3; 269/910

(56) References Cited

U.S. PATENT DOCUMENTS

| | | | | |
|---|---|---|---|---|
| 3,212,694 | A | | 10/1965 | Sanford |
| 3,255,943 | A | | 6/1966 | Sanford |
| 3,413,703 | A | | 12/1968 | Sanford |
| 3,419,205 | A | | 12/1968 | Jureit et al. |
| 3,538,843 | A | * | 11/1970 | Lubin ..... 100/353 |
| 3,540,107 | A | | 11/1970 | Jureit et al. |
| 3,605,608 | A | | 9/1971 | Dagley |
| 3,628,714 | A | | 12/1971 | Offenwanger |
| 3,667,379 | A | | 6/1972 | Templin |
| 3,711,007 | A | | 1/1973 | Fry |
| 3,785,277 | A | | 1/1974 | Schmitt |
| 3,855,917 | A | | 12/1974 | Farrell et al. |
| 3,925,870 | A | | 12/1975 | Adams |
| 3,939,764 | A | | 2/1976 | McCormack |
| 4,024,809 | A | | 5/1977 | Moehlenpah |
| 4,084,498 | A | | 4/1978 | Weaver |
| 4,295,269 | A | | 10/1981 | Wright |
| 4,351,465 | A | | 9/1982 | Moehlenpah et al. |
| 4,373,652 | A | | 2/1983 | Matlock et al. |
| 4,384,515 | A | | 5/1983 | Matlock |
| 4,437,234 | A | | 3/1984 | Thornton |
| 4,485,606 | A | | 12/1984 | Gottlieb |
| 4,570,913 | A | | 2/1986 | Rosser |
| 4,669,184 | A | | 6/1987 | Castillo |
| 4,955,742 | A | | 9/1990 | Marks |
| 5,092,028 | A | | 3/1992 | Harnden |
| 5,111,861 | A | | 5/1992 | Gore et al. |
| 5,211,108 | A | | 5/1993 | Gore et al. |
| 5,553,375 | A | | 9/1996 | Powers |
| 5,768,769 | A | | 6/1998 | Shamblin |
| 6,079,325 | A | * | 6/2000 | LePoire et al. ..... 100/210 |
| RE37,797 | E | | 7/2002 | Haase |

OTHER PUBLICATIONS

MiTek® Mark V™ Gantry System, 4 pgs., 1993.
MiTek® Roller Gantry Roller Press System, 4 pgs., 1994.
MiTek® Finish Roller, 2 pgs., 1994.
MiTek® RailRider™ Trackless Floor Truss Roller System, 4 pgs., 1997.
MiTek® RoofGlider® Trackless Roof Truss Roller System, 4 pgs. 1998.

* cited by examiner

*Primary Examiner*—Allen Ostrager
*Assistant Examiner*—Shelley Self
(74) *Attorney, Agent, or Firm*—Senniger Powers

(57) ABSTRACT

A truss assembly apparatus for use in assembling a truss. The apparatus has a truss table and a roller assembly movable relative to the truss table for pressing connectors into truss members. A wheel guide directs movement of the roller assembly relative to the truss table. The roller assembly automatically reduces speed when approaching an end of the wheel guide. A wear strip is removably secured to the guide so that the wear strip may be replaced with a different wear strip without replacement of the guide. The table is supported on legs which are telescopically adjustable in height to adjust the table to a level orientation. A support of the roller assembly is formed of a one piece plate to inhibit deflections. A roller is formed with a collar attached by interference fit to improve strength and durability.

9 Claims, 12 Drawing Sheets

TRUSS ASSEMBLY APPARATUS

BACKGROUND OF THE INVENTION

This invention relates generally to the assembly of trusses, and in particular to a gantry press for assembling trusses which provides several advantageous features.

Pre-manufactured structural frameworks, such as trusses, are widely used in the construction industry for forming a roof, wall panel, floor, or other building component. Each truss includes a collection of wooden, plastic, or metallic truss members held together by connectors, such as nailing plates. The truss is assembled to the correct specifications at a factory and then shipped to a construction site. A gantry press apparatus is frequently used to facilitate efficient assembly of the truss. It features a table on which the truss members and connectors are placed at desired relative positions to form the particular truss configuration. A motorized roller apparatus (i.e., the gantry) then travels along the table to press the connectors into the truss members thereby joining them together. The roller apparatus includes a cylindric roller, two opposite supports, and several wheels mounted on wheel guides along opposite sides of the table. After traversing the length of the table, the roller apparatus continues moving along the guides and is stopped in a parking area at an end of the table such that the assembled truss can be freely removed from the table without obstruction by the roller apparatus.

The present invention improves upon gantry press devices of the prior art, which unfortunately have a number of potential difficulties. For example, initial installation of the table to a perfectly level orientation can be time consuming. Legs of the table have a fixed height, with a height-adjusting bolt attached to each leg and positioned at or near the ground. A relatively narrow width of the bolt leaves the table subject to rocking, and its position makes it difficult to adjust.

Prior art supports of the roller apparatus are subject to becoming warped or misaligned relative to the table. Typically these supports comprise frames assembled from several pieces which are welded together, and consequently are subject to inaccuracies in attachment or tolerance stack-up. Further, the frames have a relatively lighter weight which permits deflections (warp) under typical loads.

Operators control the roller apparatus with a joystick controller for varying speed. There is no automated slowdown when the roller apparatus reaches the parking area, and consequently operators can inadvertently permit the roller apparatus to continue moving through the parking area into collision with an end stop. That collision typically causes damage.

Wheel guides become worn due to repetitive use and contact from wheels, and replacement of guides on prior art systems is expensive and time consuming. Guides typically comprise bars, tubes, or tracks securely mounted along opposite sides of the truss table for supporting and directing movement of the roller assembly relative to the truss table. When worn, replacement of the guides is costly and results in substantial down time for the apparatus.

The roller is constructed with a central shaft and axial disks mounted on the shaft to support a cylindric outer surface of the roller. Strength and durability of the roller are degraded when the axial disks are attached to the shaft by direct welding. Welding crystallizes certain materials at the weld, leading to subsequent cracks or breakage.

Reference is made to the following co-assigned U.S. patents for further background regarding truss assembly systems, which are hereby incorporated by reference:

| Pat. No. | Date | Title |
|---|---|---|
| 6,079,325 | Jun. 27, 2000 | Trackless Gantry Press System |
| Re 37,797 | Jul. 23, 2002 | Truss Assembly Apparatus with Independent Roller Drive |

SUMMARY OF THE INVENTION

Among the several objects and features of the present invention may be noted the provision of a truss assembly apparatus having a truss table which may be readily adjusted to a level orientation and adjusted in height; the provision of such an apparatus which provides accurate alignment between a roller apparatus and a table; the provision of such an apparatus which has a strong and durable roller; the provision of such an apparatus which inhibits collision into an end stop; and the provision of such an apparatus which provides for rapid and cost effective repair when wheel guides become worn.

In general, a gantry press apparatus of the present invention is for assembling a truss. The truss has at least two truss members and at least one connector for connecting the truss members. The apparatus comprises a truss table including a worksurface on which the truss members may be positioned. A roller assembly is movable relative to the truss table and configured to press at least one connector into the truss members to join the truss members. At least one guide is for guiding movement of the roller assembly relative to the truss table, the guide extending generally along a side of the table. A wear strip is mounted on the guide and defines a surface engageable by the roller assembly as the roller assembly moves. The wear strip is removably secured to the guide so that the wear strip may be replaced with a different wear strip without replacement of the guide.

In another aspect, a gantry press apparatus of the present invention is for assembling a truss. The truss has at least two truss members and at least one connector for connecting the truss members. The apparatus comprises a truss table including a worksurface on which the truss members may be positioned. A roller assembly is movable relative to the truss table and configured to press at least one connector into the truss members to join the truss members. A plurality of legs are for supporting the table at a position spaced above an underlying floor. At least some of the legs are telescopically adjustable in height, each having an upper leg member telescopically moveable relative to a lower leg member such that the legs may be selectively manipulated to place the table at a level orientation.

In yet another aspect, a gantry press apparatus of the present invention is for assembling a truss. The truss has at least two truss members and at least one connector for connecting the truss members. The apparatus comprises a truss table including a worksurface on which the truss members may be positioned. A roller assembly is movable relative to the truss table and configured to press at least one connector into the truss members to join the truss members. The roller assembly comprises spaced apart supports, a cylindric roller rotatably coupled to and extending between the supports, and at least one horizontal spacer extending between and interconnecting the supports. Each support is formed of a one piece plate configured to inhibit deflection of the plate under loads experienced by the plate.

In still a further aspect, a gantry press apparatus of the present invention is for assembling a truss. The truss has at least two truss members and at least one connector for connecting the truss members. The apparatus comprises a truss table including a worksurface on which the truss members may be positioned. A roller assembly is movable relative to the truss table and configured to press at least one connector into the truss members to join the truss members. At least one guide is for guiding movement of the roller assembly relative to the truss table, the guide having an end region generally beyond the worksurface. A motor system is for driving the roller assembly along the guide. A mechanism is for controlling the motor system to automatically reduce a speed of the roller assembly when the roller assembly moves beyond a predetermined position within the end region of the guide.

In one more aspect, a roller of the present invention is for use in a gantry press apparatus for assembling a truss having at least two truss members and at least one connector for connecting the truss members. The roller comprises a central shaft which is rotatably mounted in the apparatus, the shaft having a longitudinal axis and a diameter. A cylindrical drum is rotatable with the shaft and has an outer surface configured for pressing at least one connector into the truss members to join the truss members. At least two support disks are positioned inside the drum, each disk being coaxially aligned with the shaft and having opposite faces and an outer circumferential surface in engagement with an inner surface of the drum. An annular sleeve is mounted on the shaft, the sleeve including an inner surface having an inner diameter, an outer surface, and an axial end attached to one of the disks. The inner diameter of the sleeve is less than the diameter of the shaft such that the sleeve is mounted on the shaft with an interference fit free of a welded connection.

Other objects and features of the present invention will be in part apparent and in part pointed out hereinafter.

BRIEF DESCRIPTION OF THE DRAWINGS

Corresponding reference characters indicate corresponding parts throughout the views of the drawings.

DETAILED DESCRIPTION OF THE PREFERRED EMBODIMENT

Figure 1:
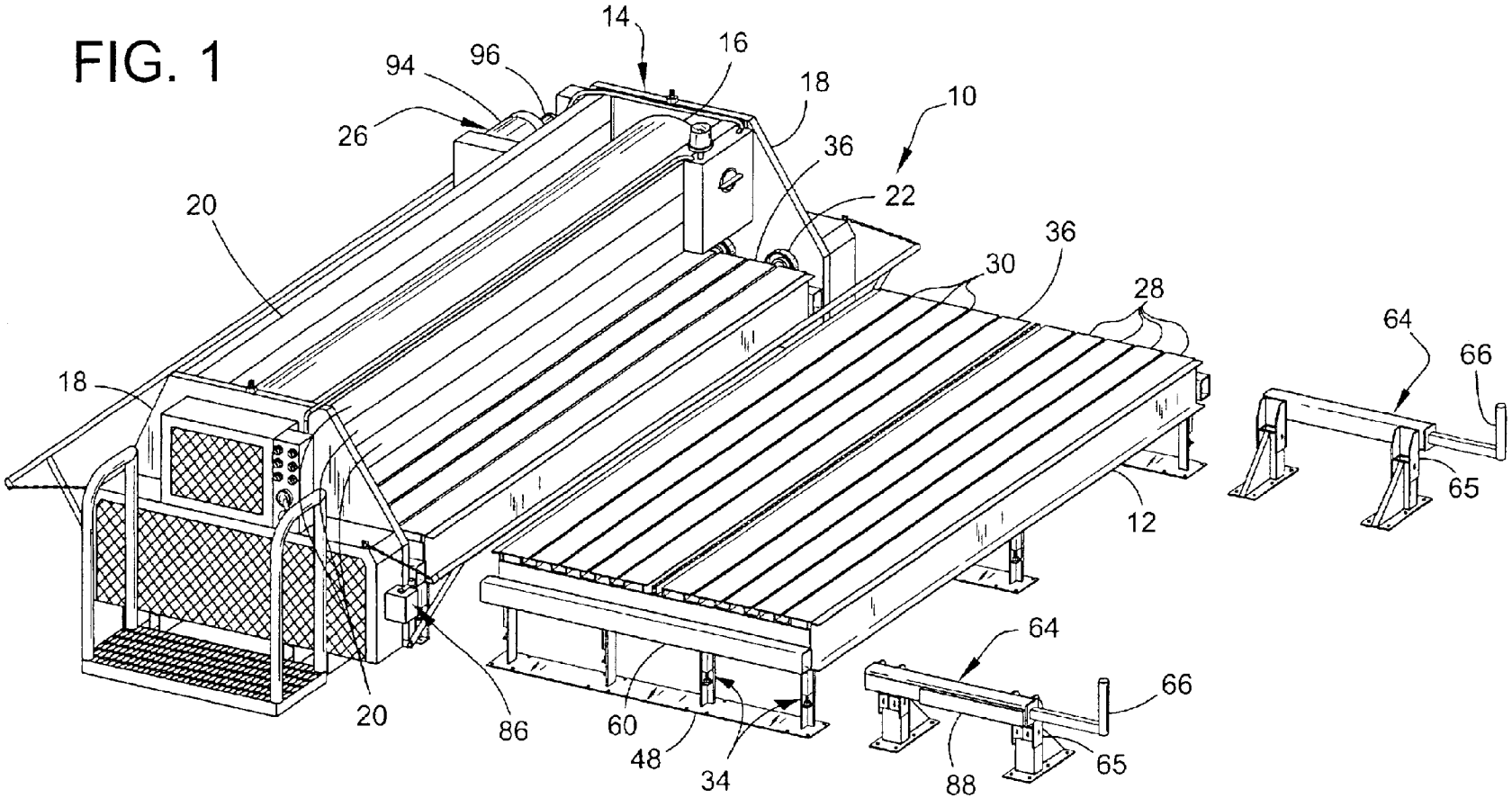
FIG. 1 is a perspective of a truss assembly apparatus of the present invention.
Figure 2:
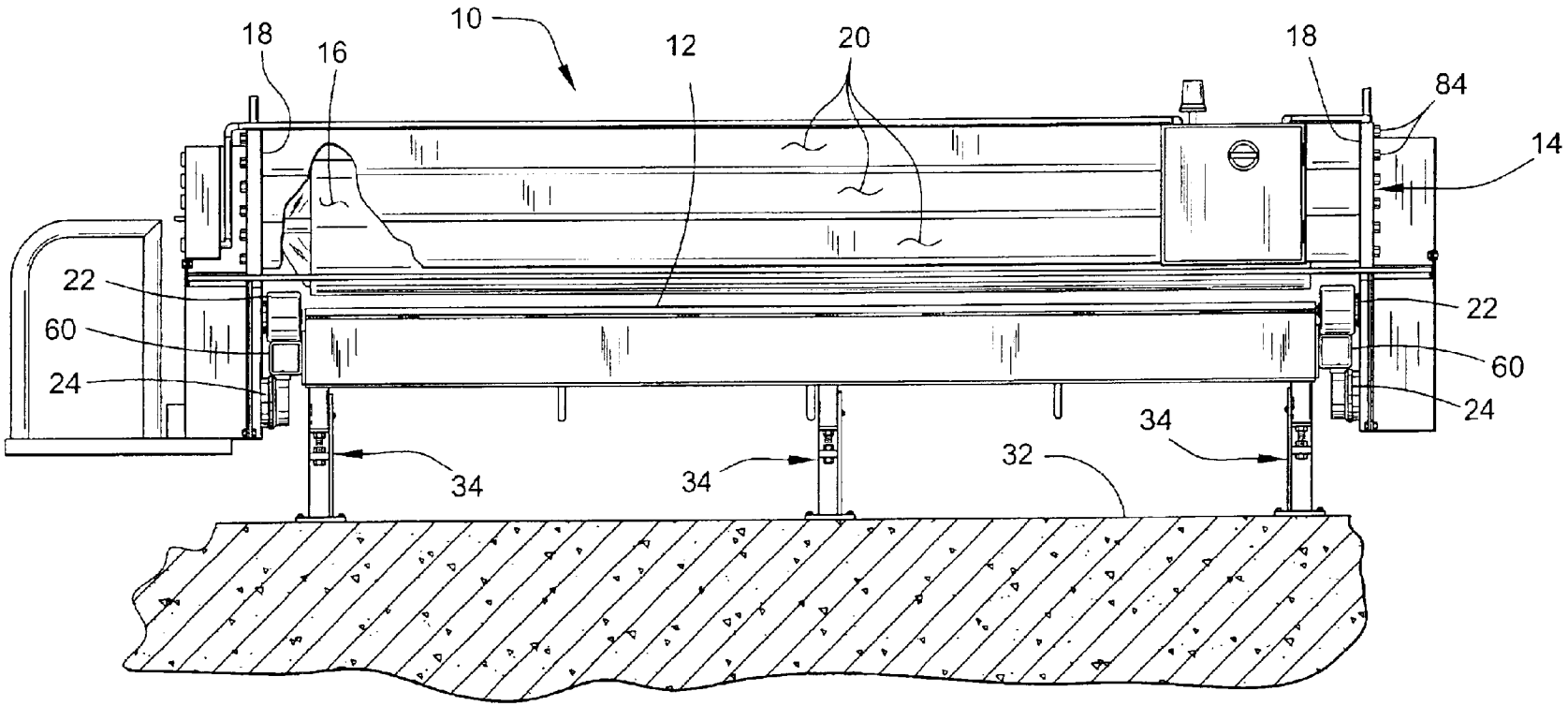
FIG. 2 is an end elevation of the apparatus of FIG. 1, partially broken away to show internal construction.

Referring now to the drawings and in particular to FIG. 1, a truss assembly apparatus according to the present invention is indicated generally at 10. The apparatus includes a truss table 12 on which truss members and connectors (not shown) may be positioned at a desired configuration for assembly to form a truss. A roller assembly, indicated generally at 14, is movable relative to the truss table 12 and has a cylindric roller 16 configured to press one or more connectors into the truss members to connect the truss members. The roller 16 extends between and is rotatably coupled to two spaced apart supports 18. Each support 18 is a generally vertically oriented plate, as further described hereinafter, and interconnected with the opposite support by horizontal spacers 20 extending between the supports. Each support 18 is mounted on four drive wheels 22 aligned in an upper row along the support and four reaction pressure wheels 24 (FIG. 2) aligned in a lower row along the support. The roller 16 and drive wheels 22 are connected in a conventional manner by one or more drive chains (not shown) to a motor system indicated generally at 26. The roller assembly 14 can have other configurations, such as different supports or number of wheels, without departing from the scope of this invention.

The truss table 12 has a plurality of parallel, elongate panels 28 providing a worksurface for placement of truss members. A slot 30 is left between adjacent pairs of panels 28 suitable for placement of conventional positioning stops (not shown) capable of being fixed along the slot to collectively form a jig for correct location and placement of truss members on the worksurface. The table 12 is supported above an underlying floor 32 by a plurality of adjustable length legs, indicated generally at 34, as described in more detail below.

The truss table 12 includes two or more spaced sections 36 of table which are aligned in a row, the number of sections depending on the size of the truss being assembled. During operation, truss members may rest solely on one section 36, or if larger may extend across several sections. Two spaced sections 36 are illustrated in FIG. 1, although it is to be understood that a truss table may include only a single section or any number of sections without departing from the scope of the present invention. A horizontal spacing between adjacent sections 36 is suitable for a person to walk in between the sections to set up the truss members and connectors, with a typical spacing being 15 inches. In the preferred embodiment, each section 36 has thirteen legs, including ten telescopically adjustable legs 34 and three adjusting reaction legs (not shown). Other numbers and types of legs do not depart from the scope of this invention.

Figure 5:
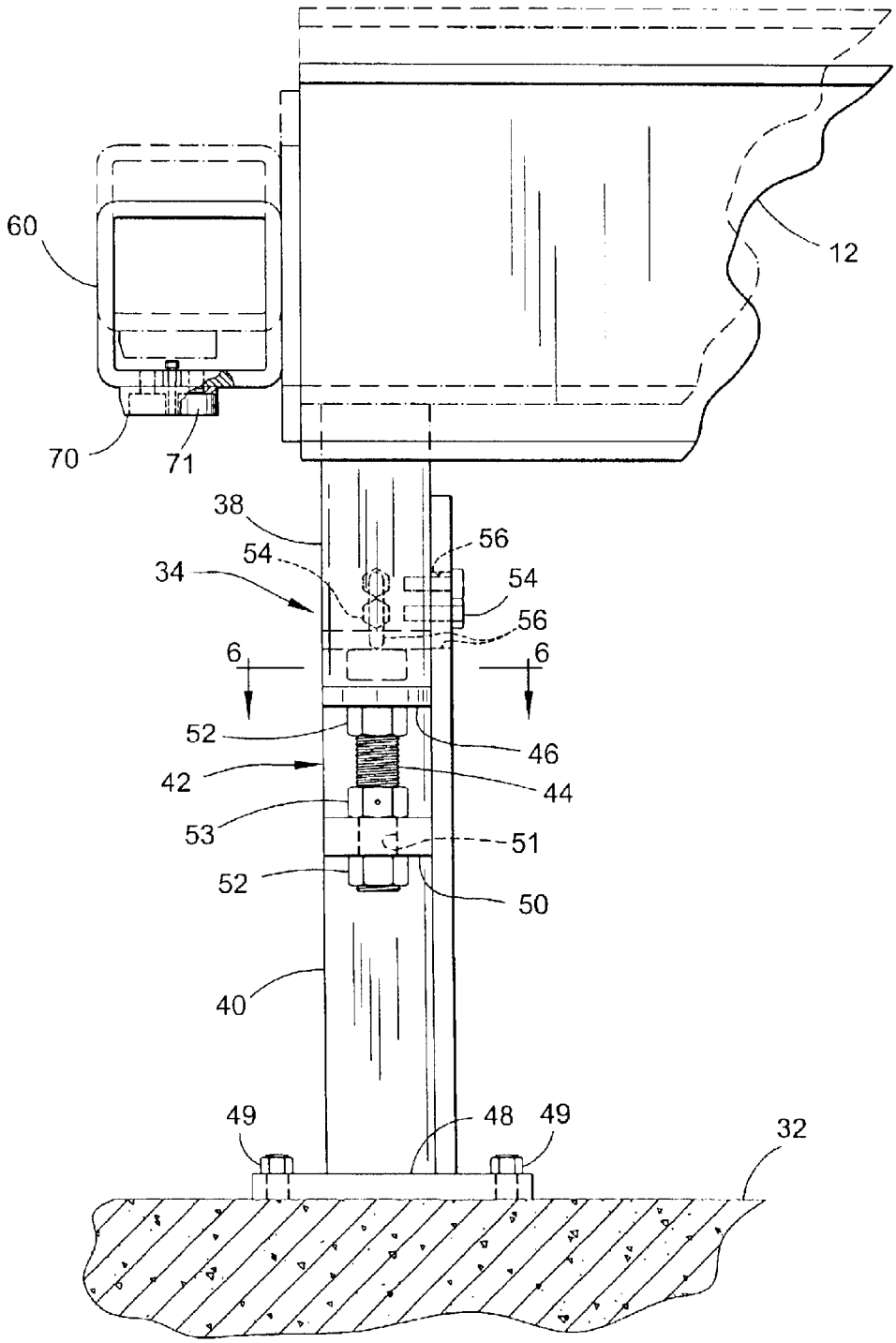
FIG. 5 is an enlarged fragment of FIG. 2 with the roller assembly removed and illustrating height adjustability.
Figure 6:
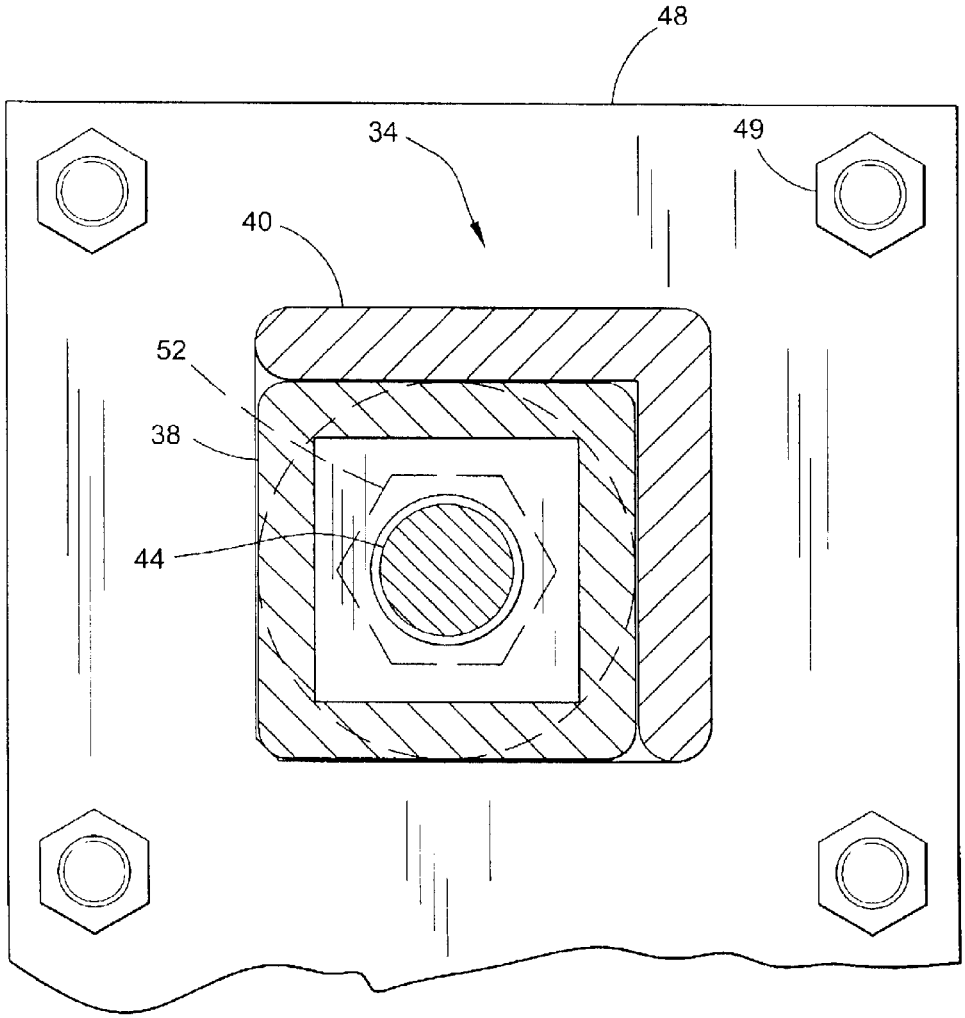
FIG. 6 is a section taken on line 6—6 of FIG. 5.

Referring now to FIGS. 5 and 6, the legs 34 support the table 12 at a position spaced above the underlying floor 32. During initial installation, the table 12 must be placed at a level orientation to enable proper operation of the apparatus 10. The legs 34 are adjustable in length and may be selectively and individually manipulated as needed to place the table 12 at that orientation. Each leg 34 includes an upper leg member 38 and a lower leg member 40 which are telescopically moveable relative to each other to change the length of the leg. An adjustment mechanism, indicated generally at 42, is configured for holding the upper and lower leg members 38, 40 in different selected positions of extension for selecting the height of the leg.

The upper leg member 38 comprises a rectangular tube, and the lower leg member 40 comprises an angle iron. The leg members 38, 40 are sized for engagement over a substantial portion of respective surfaces, in a nesting relationship as shown in FIG. 6, to promote stability and exclusively vertical motion as the members telescope relative to each other to change length. Further, the leg members 38, 40 overlap in substantial vertical extent to permit a corresponding range of height adjustability for the table 12. The adjustment mechanism 42 includes a threaded bolt 44 attached to and extending from a lower end plate 46 of the upper leg member 38. The lower leg member 40 is supported on a floor plate 48 (FIGS. 1 and 5) which may be fixedly attached to the floor 32, such as by threaded fasteners 49 which extend into the floor or by welding. The floor plate 48 comprises an elongate steel, such as cold rolled steel, which is configured into a perfectly level orientation on the floor 32. Each section 36 of table has three floor plates 48 (FIG. 1), each plate engageable by several legs. It is understood that other configurations for engaging the floor, such as a flat foot on each lower leg member 40 or direct engagement of the floor with no foot or floor plate, do not depart from the scope of this invention.

A transverse gusset 50 extends between sides of the lower leg member 40. The gusset 50 has an unthreaded hole 51 for receiving the bolt 44 for selectively adjusting a relative position of the upper and lower leg members 38, 40. Two nuts 52 are positioned on the bolt 44 below the lower end plate 46 and the gusset 50, respectively. An adjusting nut 53 is positioned on the bolt 44 above the gusset 50, the nut 53 having a locking pin for locking rotation. The truss table 12 is moveable up or down such as between the two positions shown in solid and phantom on FIG. 5.

Significantly, the adjustment mechanism 42 is spaced above the floor 32, and more specifically at a position about halfway up the leg 34. That facilitates easier and more rapid adjustment relative to prior art legs which have an adjusting bolt at the floor level. Moreover, the leg 34 is stable and inhibits any instability or wobble because the floor plate 48 provides a larger surface area for engaging the floor than on prior art systems. It is understood that one or more of the legs may be fixed in height, or have different height adjustment provisions (e.g., hydraulic cylinders), without departing from the scope of the invention.

Two guide screws 54 (FIG. 5) are fastened to the upper leg member 38 and received through vertical slots 56 in the lower leg member 40. The guide screws 54 ensure that the upper and lower leg members 38, 40 remain in alignment as the leg is adjusted in height, and provide an additional locking feature.

To change height, the nuts 52 and guide screws 54 are first loosened. Adjustment is accomplished by rotation of the nut 53, with the guide screws 54 sliding in respective slots 56 as the upper leg member 38 moves relative to the lower leg member 40. The screws 54 prevent any twist or misalignment of the leg members 38, 40. The nuts 52 and screws 54 are re-tightened to secure the leg 34 at the selected height.

Figure 3:
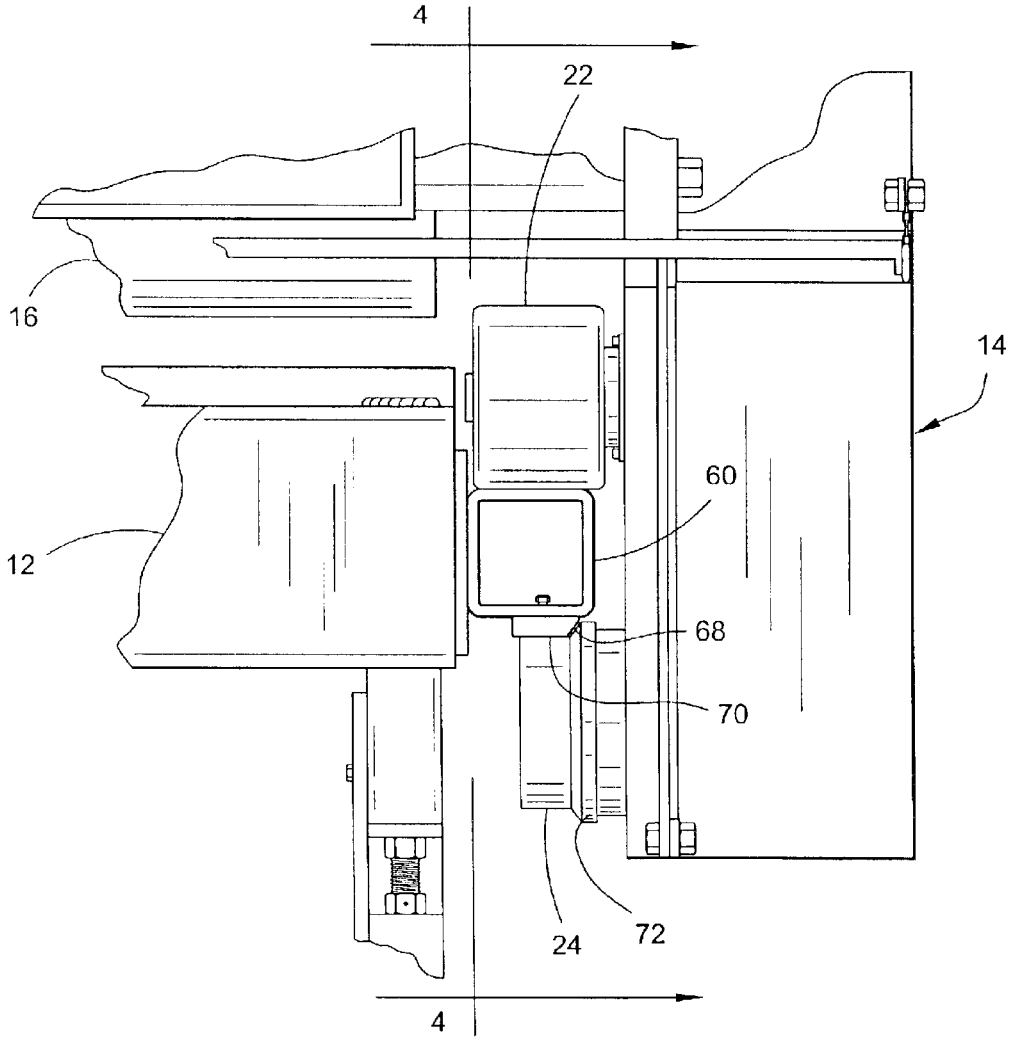
FIG. 3 is an enlarged fragment of FIG. 2 showing wheels of a roller assembly of the apparatus engaging a guide of the apparatus.
Figure 4:
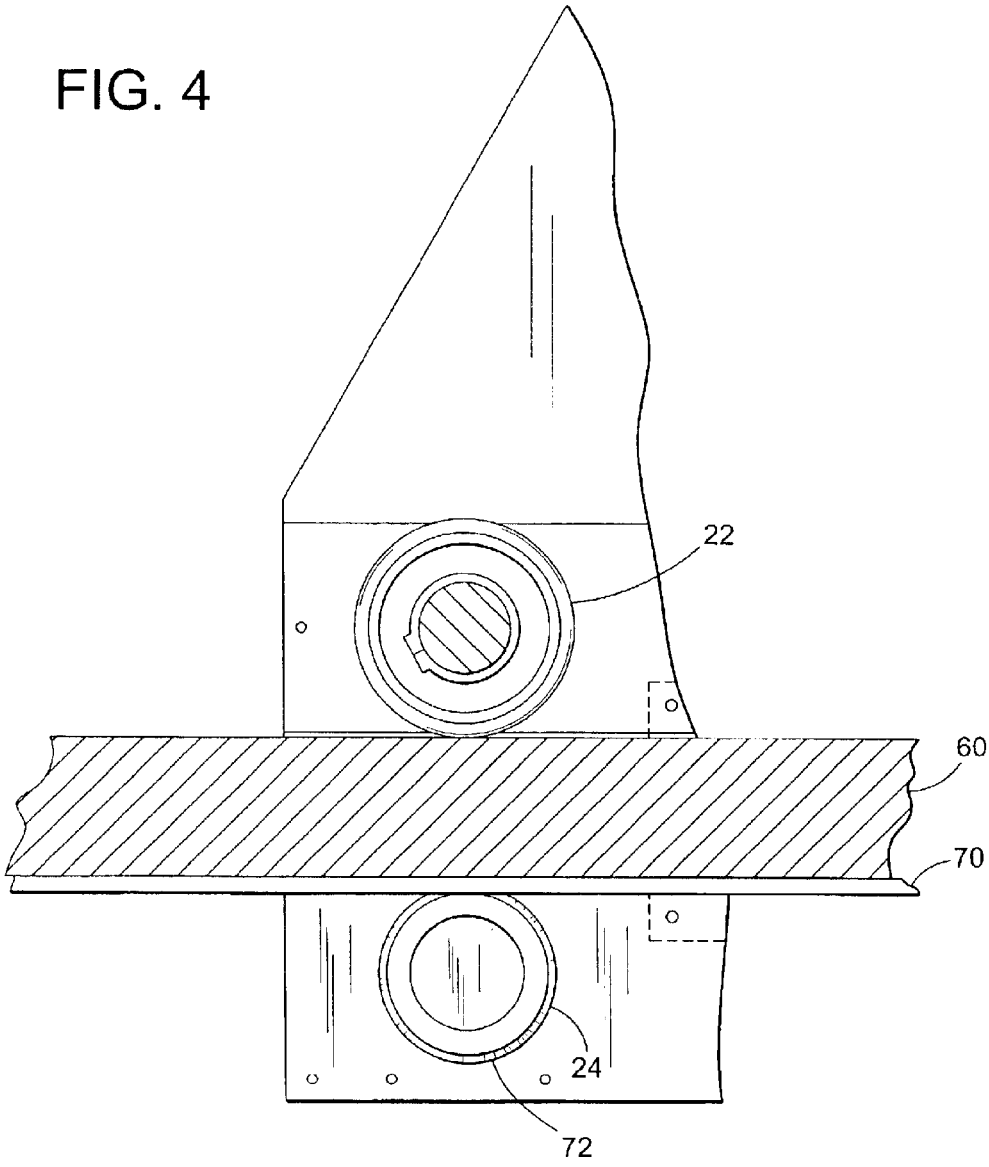
FIG. 4 is a fragmentary section taken along line 4—4 of FIG. 3.

Two wheel guides 60 are securely mounted along opposite sides of the truss table 12. The guides 60 are provided for supporting and directing movement of the roller assembly 14 relative to the truss table. Each guide 60 comprises a suitably shaped elongate beam extending generally along the table 12 and which provides tracks for engagement by drive wheels 22 and pressure wheels 24 of the roller assembly 14, as shown in FIGS. 3 and 4. For instance, in the preferred embodiment, each guide 60 is formed of a five inch by five inch steel tube. An upper side of the guide 60 is a generally flat surface which provides a track for the drive wheels 22. A lower side of the guide 60 is a generally flat surface suitable for providing a track for the pressure wheels 24. It is understood that there could be other types and locations of guides, or only one guide, without departing from the scope of this invention.

A parking area, indicated generally at 64 in FIG. 1, is aligned with and spaced from the endmost section 36 of the truss table 12. The parking area 64 comprises an end region of the wheel guide 60 which is positioned beyond an end of the truss table 12. After the roller assembly 14 has traveled along the length of the truss table 12, it moves to the parking area 64 where it may be stopped and where it does not overlie the assembled truss so as to not interfere with removal of the truss. The parking area 64 includes legs 65 (FIG. 1) which are adjustable in height to correspond with a height of the table 12, in particular with a height of the guides 60, so that the roller assembly 14 smoothly moves onto the parking area. A vertical end stop 66 is mounted to the parking area 64. An additional parking area (not shown) may be provided on an opposite end of the truss table.

When the motor system 26 is activated, the drive wheels 22 move the roller assembly 14 until the roller 16 rolls onto the surfaces of the truss members and connectors. At that point, the drive wheels 22 become substantially unloaded, with the weight of the roller assembly 14 bearing on the roller 16 and therethrough on the connectors. The pressure wheels 24 augment a pressing force imparted by the roller 16 onto the connectors (i.e, beyond the weight of the assembly), by preventing substantial upward movement of the roller 16 when rolling over truss members.

A replaceable wear strip 70 is mounted on each guide 60 to facilitate replacement of worn parts while avoiding a costly and time consuming replacement of the entire guide or section of guide. The wear strip 70 is removably secured by suitable fasteners to a lower side of the guide 60, where it defines a surface engageable by the pressure wheels 24 as the roller assembly 14 moves. When a section of wear strip 70 becomes worn, it may be readily replaced with a new or different wear strip. The wear strips 70 are positioned where visual inspection as to wear is easily performed. In the preferred embodiment, each wear strip 70 is an elongate, generally rectangular shaped bar which extends along an entire length of the truss table section 36. In the preferred embodiment, it is formed of 0.75 inch thick steel. An outer side 68 (FIG. 3) of each wear strip 70 is sloped at an angle, such as twenty degrees from vertical, for improved engagement by the pressure wheels 24. The wear strip 70 is secured to the guide 60 by fasteners 71 (FIG. 5). In the preferred embodiment, each wear strip 70 has nineteen fasteners 71 including fifteen screws spaced along the wear strip and four alignment cap screws received in respective spaced longitudinal slots (not shown) in the guide 60 for aligning and locking the wear strip to the guide. It is understood that the wear strip 70 can have other shapes, can be formed of another material including a plastic, and can be attached to the guide by different fasteners or by welding without departing from the scope of this invention.

The pressure wheels 24 of the roller assembly 14 include outer side flanges 72 (FIG. 3) which are engageable with the wear strips 70 to maintain proper alignment between the roller assembly 14 and the truss table 12. The flanges 72 flare outwardly from the flat circumference of each wheel 24 such that they have a conical shape configured to engage the wear strip 70. In the preferred embodiment, both the flanges 72 and the outer side 68 of the wear strip are sloped at corresponding angles of about twenty degrees from vertical. Other angles do not depart from the scope of this invention.

Further, the slopes do not need to be equal, such as the side 68 being vertical. If one side of the roller assembly 14 and its support 18 should move slightly ahead of the opposite side, the flanges 72 force the roller assembly back into correct position relative to the truss table, thereby providing the roller assembly with a self-alignment capability. That precludes the need for more complex alignment members utilized in devices of the prior art, such as sets of wheels which engage opposite, outer lateral sides of the guides. It is understood that the flanges 72 may engage the guide 60 directly, instead of engaging the wear strip 70.

Figure 8:
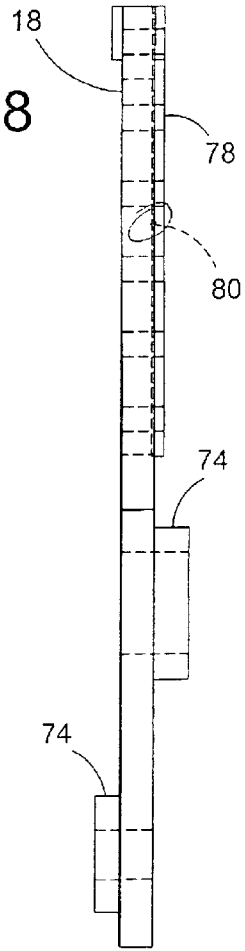
FIG. 8 is an end elevation of the support of FIG. 7.
Figure 7:
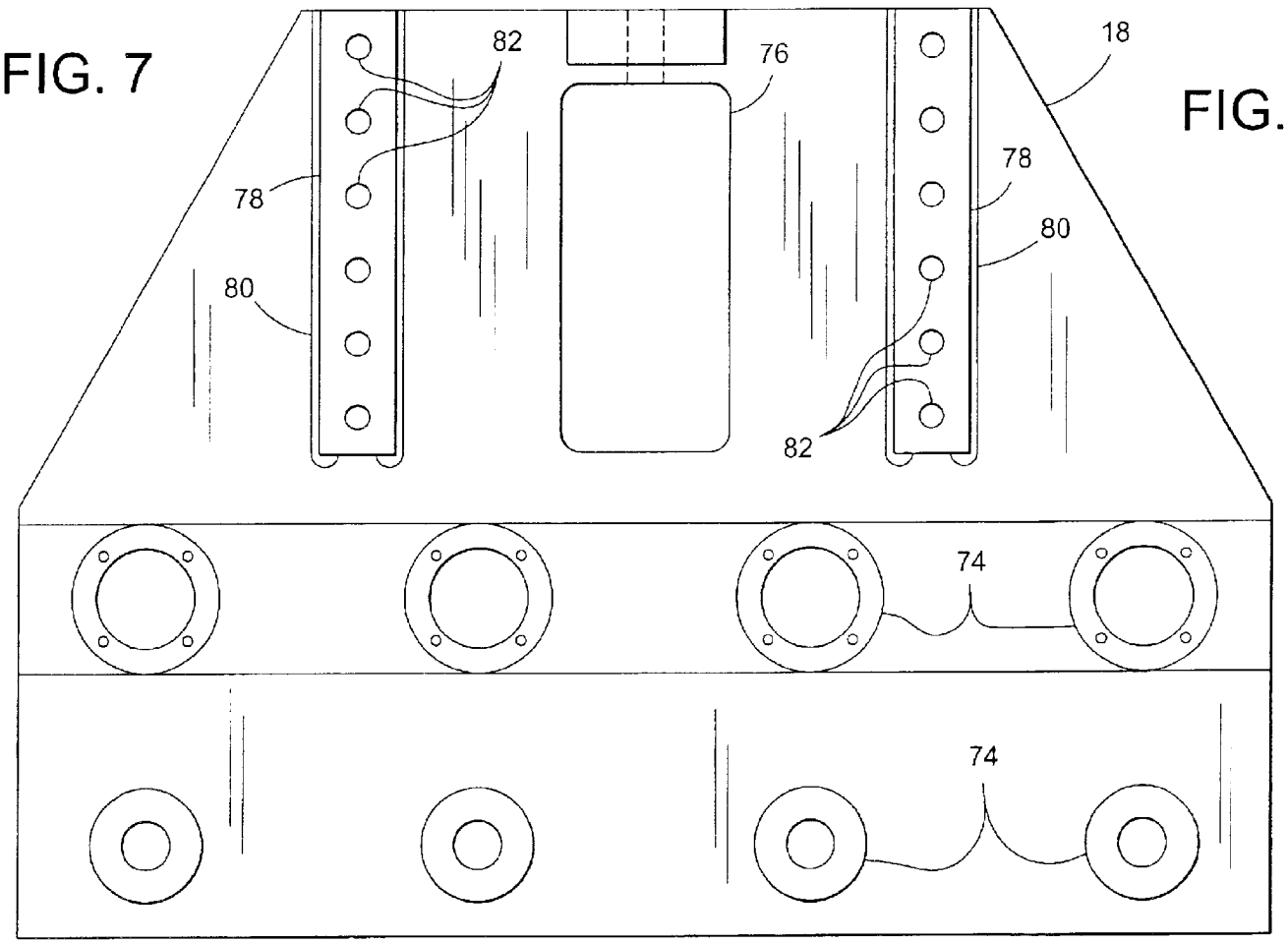
FIG. 7 is a side elevation of a support of the roller assembly with surrounding parts removed.

Referring to FIGS. 7 and 8, each support 18 is formed to inhibit deflection during operation of the apparatus 10 and thereby improve accuracy and quality. Unlike a support of the prior art which may comprise an assembled frame, the support 18 of the present invention is a plate formed of one solid piece of rigid material. That precludes the possibility of misalignments or inaccurate attachments because the support 18 is not assembled from multiple pieces. In the preferred embodiment, the support 18 is two inch thick solid steel. The substantial weight of the support 18 provides rigidity and inhibits deflections, and being made of one piece promotes a flat contour to facilitate accurate, square alignment relative to the table 12.

Hubs 74 for mounting the drive wheels 22 and pressure wheels 24 are attached to the support 18 by a suitable connection such as by welding. A cavity 76 is provided in the support 18 for mounting an assembly (not shown) to support the roller 16 and adjust its vertical position relative to the truss table 12 to configure the apparatus as needed for the thickness of the truss members being joined. Conventional drive chain sprockets and chain tightening adjusters (not shown) are also mounted on the support 18 for operatively connecting the motor system 26 to the drive wheels 22 and roller 16.

The horizontal spacers 20 (FIGS. 1 and 2) extend between the two opposite supports 18 and are configured to ensure accurate, parallel alignment of the supports. There are six spacers 20 in the preferred embodiment. Each spacer 20 is formed of a rectangular tube with a close dimensional tolerance so that all spacers have a uniform length and squared ends.

The spacers 20 are configured with varying weights in order to weight balance the roller assembly 14. As shown in FIG. 1, the motor system 26 is mounted on the roller assembly 14 at an offset or non-centered position relative to the support 18, being located toward one lateral side of the roller 16. Consequently, the weight of the motor system 26 can cause the roller assembly 14 to have an uneven weight distribution among the wheels 22 or 24, with one side being heavier than the other. To counter this, the spacers 20 are configured with varying wall thicknesses (not shown) to provide selectable weights. The three spacers 20 which are positioned away from the motor system 26 (i.e., on the opposite side of roller 16) have a greater weight than the three spacers 20 positioned toward the motor system. The spacers 20 function as a counterbalance to the weight of the motor system 26.

Two mounting plates 78 (FIGS. 7 and 8) are attached to the spacers 20 and supports 18 for accurately connecting these parts so that the spacers extend in a precisely horizontal direction between the vertically oriented supports. The mounting plates 78 are initially attached as by welding to the spacers 20, and are subsequently attached to the supports 18 when assembling the roller assembly 14. Each mounting plate 78 is accurately machined to a thin, flat contour and is formed of a material suitable for precise tolerances so that the mounting plate 78 remains flat and free from warp. In the preferred embodiment, the mounting plate is formed of a cold rolled steel, which as known to those skilled in the art is of higher grade than hot rolled steel which forms the supports 18 and spacers 20. The mounting plate 78 is received in a recessed region 80 machined on the support 18 which has an accurately flat surface. The squared ends of the spacers 20 accurately engage the mounting plates 78. Six tapped holes 82 in each mounting plate 78 are aligned with six corresponding holes in the support 18 for receiving bolt fasteners (visible on FIG. 2) to connect the spacers 20 to the supports, with the mounting plate being in a sandwiched position therebetween. The bolt fasteners 84 are tightened until the spacers 20 are loaded in compression to a substantial force (1,975 foot-pounds torque are applied in tightening each 1.25 inch bolt fastener 84 in the preferred embodiment). The roller assembly 14 is a rigid unit with the supports 18 being parallel and vertically oriented and with the spacers being horizontal.

Figure 9:
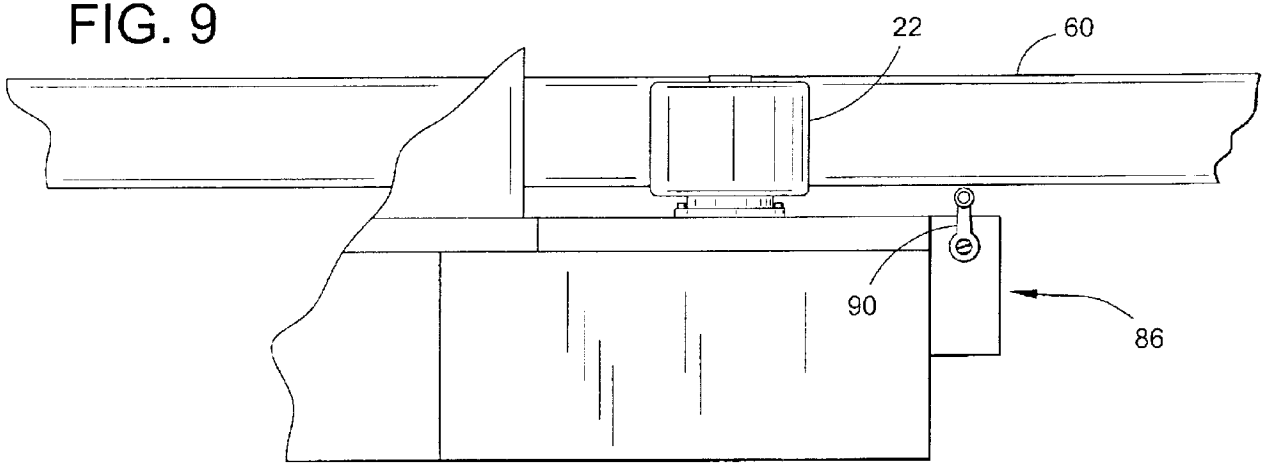
FIG. 9 is a schematic top plan view of a fragment of the apparatus showing a roller assembly speed switch at a first position.
Figure 10:
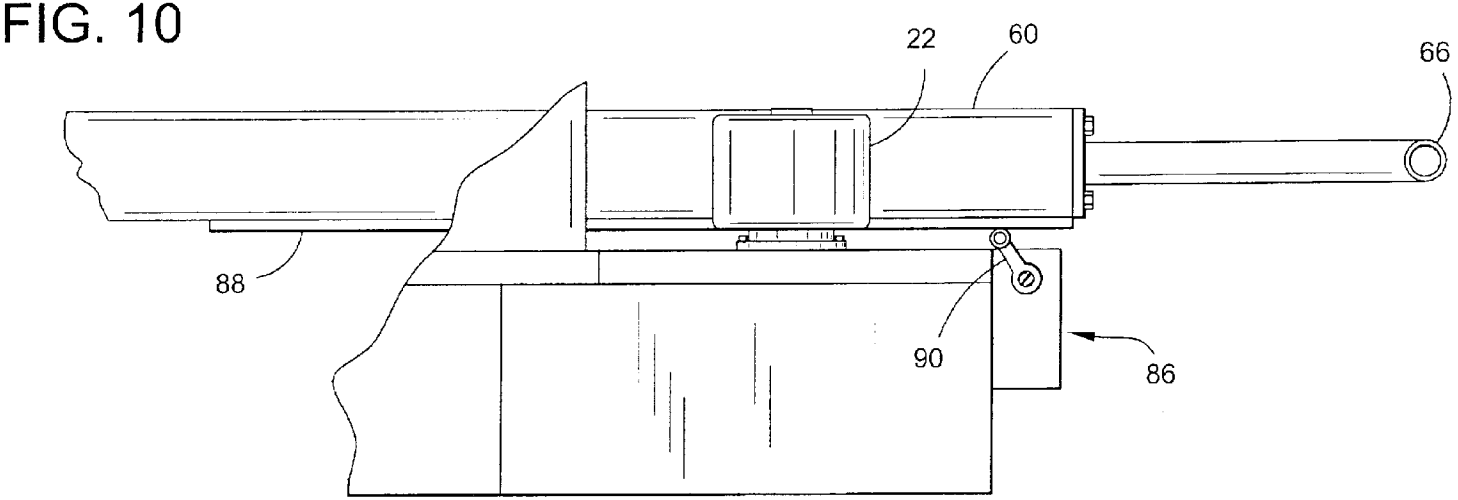
FIG. 10 is a view similar to FIG. 9 showing the switch at a second position.
Figure 11:
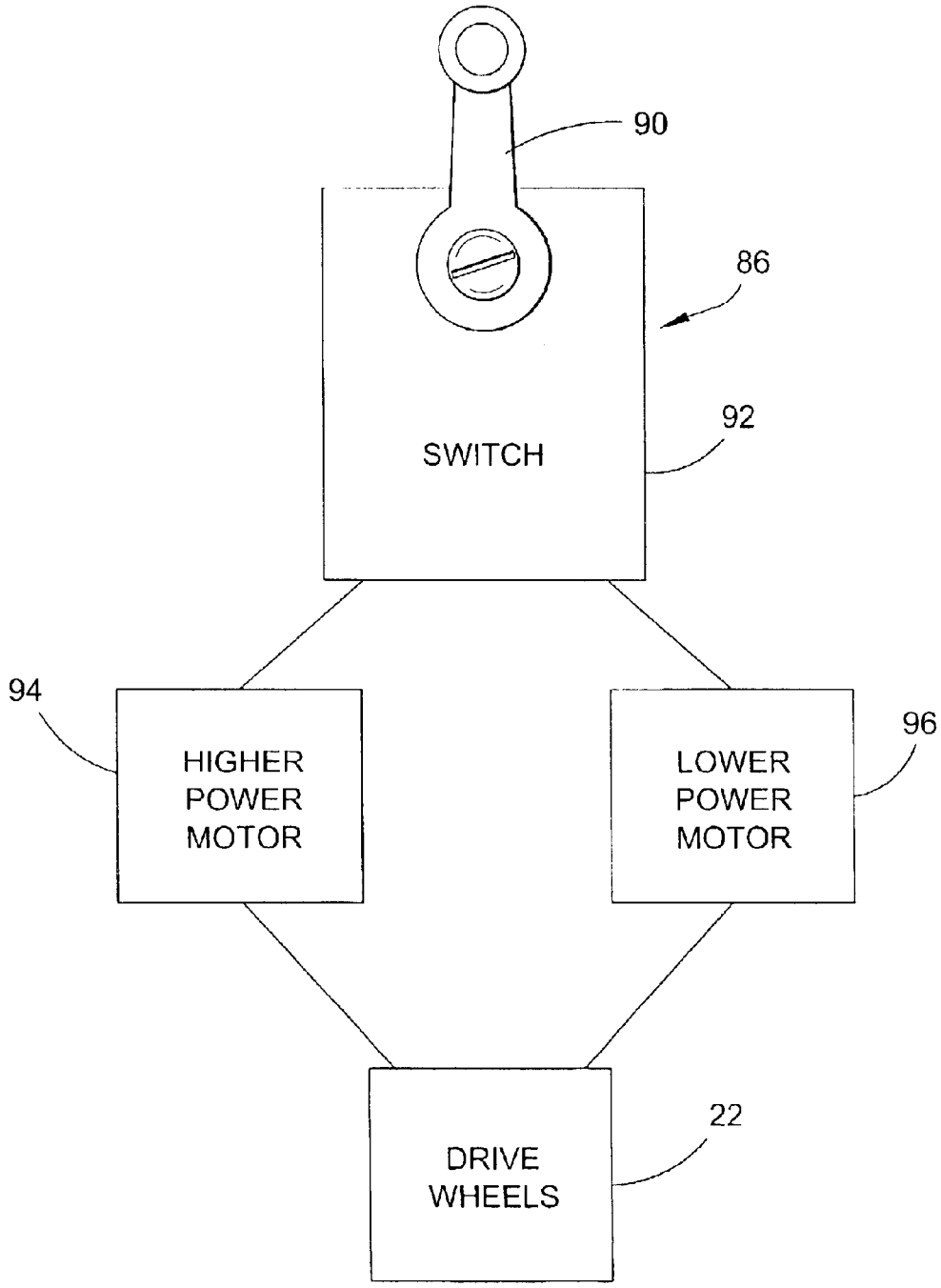
FIG. 11 is a block diagram of a control mechanism for controlling a motor system.

The present invention includes a mechanism indicated generally at 86 (FIGS. 9–11) for controlling the motor system 26 to automatically reduce a speed of the roller assembly 14 when the roller assembly moves beyond a predetermined position. The mechanism 86 inhibits damaging collisions between the roller assembly 14 and the end stop 66. The guide 60 in the parking area 64 includes a tubular beam with a bar 88 (FIGS. 1 and 10) mounted on an outer lateral side of the beam. The bar 88 functions as a trigger for changing the speed of the roller assembly 14. The bar 88 is a rectangular shaped piece of steel attached to the guide 60 by suitable fasteners such as bolts or by weldment. In the preferred embodiment, the bar 88 has dimensions about 60×2×0.5 inches and extends over about the final half of the guide 60 in parking area 64. However, the length of the bar 88 may be selected to initiate a slow-down of the roller assembly 14 at any predetermined position on the guide. The roller assembly 14 includes a sensor comprising a spring-loaded lever arm 90 mounted on the roller assembly for detecting movement of the roller assembly adjacent to the bar 88. In the preferred embodiment, the lever arm 90 is movable between a first position (FIG. 9) corresponding with a first, higher speed of the roller assembly 14 and a second position (FIG. 10) corresponding with a second, lower speed of the roller assembly. The lever arm 90 is sized and positioned to move along an outer side of the guide 60, where it is free from contact with the guide and remains at the first position while the roller assembly 14 is positioned along the truss table 12. However, when the roller assembly 14 moves to the parking area 64 and subsequently alongside the bar 88, the lever arm 90 engages the bar and is rotated to the second position. The bar 88 is shaped and positioned for moving the lever arm 90. It is understood that other types of sensors or mechanisms for determining position, including magnetic, proximity, or mechanical systems, and alternate locations on the apparatus, do not depart from the scope of this invention.

The lever arm 90 is connected to an electrical switch 92 (FIG. 11) which is operatively connected to the motor system 26 for controlling the drive wheels 22 and speed of the roller assembly 14. The switch 92 is a conventional limit switch of suitable size and type, which for the preferred embodiment is a class 9007, type C limit switch. The motor system 26 includes a higher power motor 94 and a lower power motor 96 (FIG. 1). Power ratings of motors 94, 96 on the preferred embodiment are 9.2 and 0.6 horsepower, respectively. When the lever arm 90 is moved to the second position, the switch 92 deactivates the higher power motor 94 and activates the lower power motor 96. The transition is smooth, and speed of the roller assembly 14 may decrease from about 200 feet per minute to 50 feet per minute or less. It is understood that the switch 92 could function to change a gearing ratio with a single motor or use another method to change speed of the roller assembly 14. When the roller assembly 14 moves away from the bar 88, the lever arm 90 is automatically moved back to the first position and the higher power motor 94 is activated.

Figure 12:
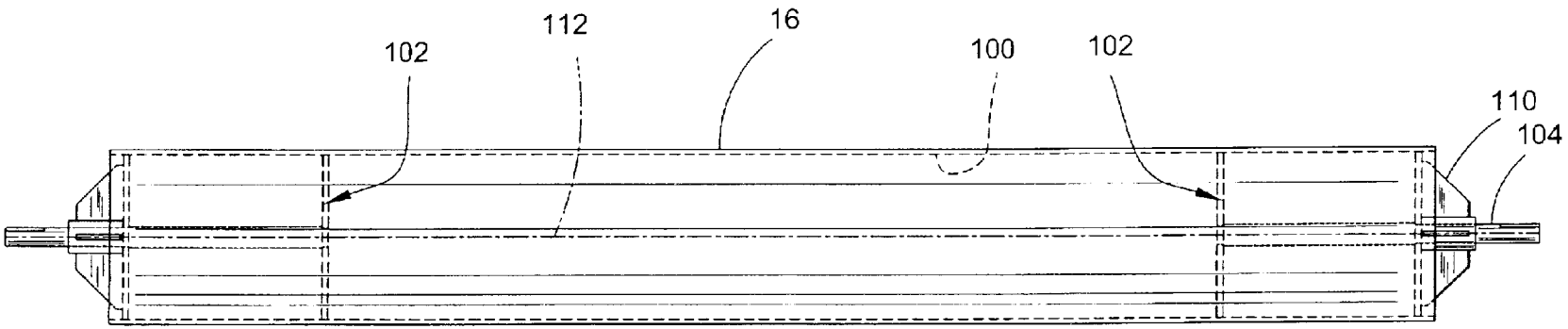
FIG. 12 is an end elevation of a roller of the apparatus.
Figure 13:
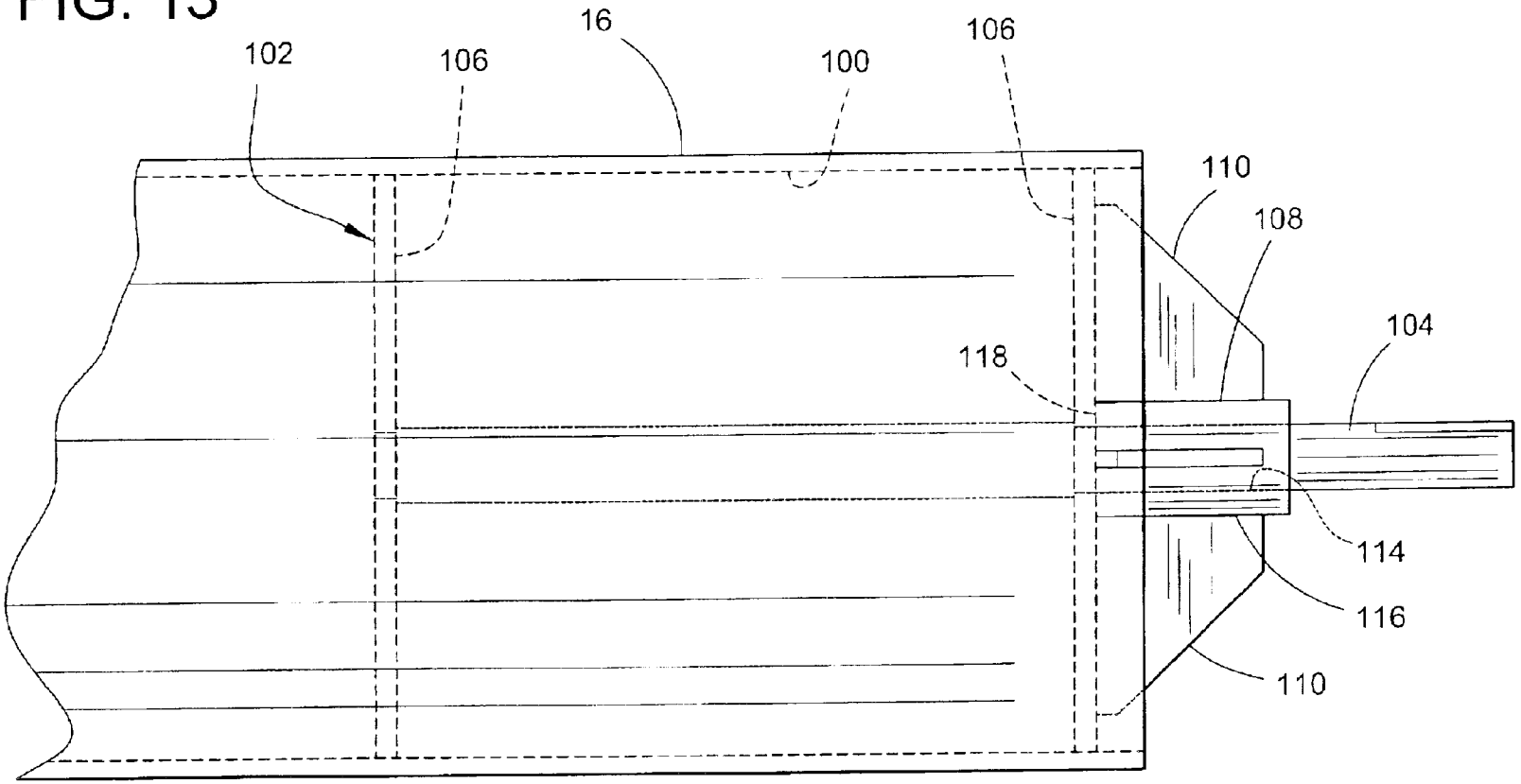
FIG. 13 is an enlarged, right end fragment of the roller of FIG. 12.
Figure 14:
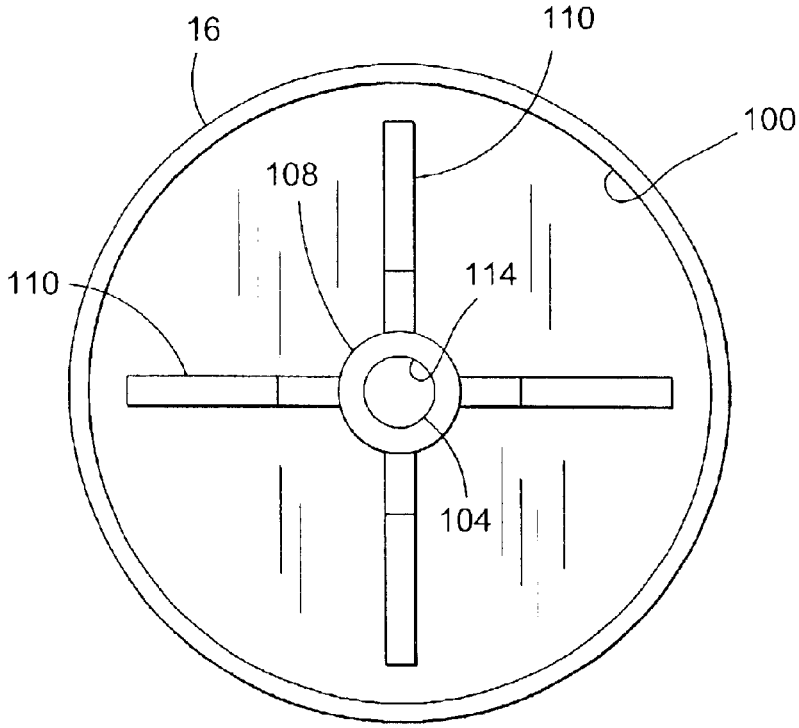
FIG. 14 is an end view of the roller of FIG. 12.

Referring to FIGS. 12–14, the roller 16 of the roller assembly 14 is constructed for strength and durability. The roller 16 has a cylindric drum 100 and two spool units, indicated in their entirety at 102, positioned generally at ends of the drum. Each spool unit 102 is attached to the inside of the drum 100 for supporting loads experienced by the drum, and includes a central shaft 104, two support disks 106, an annular sleeve 108, and gussets 110. Each shaft 104 is aligned along a longitudinal axis 112 of the roller 16 and rotatably mounted on a support 18 of the roller assembly 14. The drum 100 is rotatable with the shafts 104 and has an outer surface configured for pressing connectors into truss members to assemble the truss. Typically, the drum 100 is steel having thickness about one inch and with an outer diameter of about 24 inches (a schedule-60 24-inch pipe as known to those skilled in the art).

The two circular support disks 106 of each spool unit 102 are located at spaced positions inside the drum 100 to support the drum and provide structural rigidity. The lateral outermost disk 106 is positioned generally adjacent an end of the drum 100. Each disk 106 is sized such that an outer circumferential surface of the disk engages an inner circumferential surface of the drum 100, and these surfaces are attached by a suitable method such as by welding. Each disk 106 is attached to the shaft 104 by a suitable method such as welding, and preferably by pre-heating the region of the weld to avoid cracking. To provide an accurate diameter of the disk 106 which corresponds with an inner diameter of the drum 100, the entire spool unit 102 including the disks is preferably turned on a lathe prior to installation to remove material as necessary. Each disk 106 is oriented transverse to the longitudinal axis 112, and has a central hole which receives a portion of the shaft 104.

The annular sleeve 108 is mounted on the shaft 104 for strengthening the spool unit 102 and transmitting a majority of load between the drum 100 and the shaft 104. Significantly, the sleeve 108 is attached to the shaft 104 by an interference fit, which avoids welding on the shaft in that region which will be exposed to high stress. As known to those skilled in the art, welding can crystallize material at the location of the weld, causing subsequent cracks and shortening the expected life cycle duration of the shaft. The interference fit attachment provides adherence which is better than a welding attachment and avoids the drawbacks inherent with welding on the shaft 104. The sleeve 108 has an inner surface 114 with an inner diameter, an outer surface 116, and an axial end 118 which engages the outermost disk 106 and is attached thereto. The inner diameter of inner surface 114 of sleeve 108 is less than a diameter of the shaft 104. In the preferred embodiment, the shaft 104 has a nominal diameter of 3.625 inches, and the inner diameter of the sleeve 108 is about 3.620 inches. In the preferred embodiment, the shaft 104 is made of 4140 steel, and the sleeve 108 and gussets 110 are made of A-36 steel. For attachment to the shaft 104, the sleeve 108 is heated in an oven for about 1.5 hours to a temperature of about 1000 degrees Fahrenheit. The sleeve 108 thermally expands such that it may be easily slipped on the shaft 104. When the sleeve 108 cools and contracts, it is firmly attached by interference fit. The support gussets 110 are connected as by welding between the outer surface 116 of the sleeve 108 and the outermost disk 106. There are four gussets 110 which are equally spaced about the disk (FIG. 14). It is understood that other configurations including different arrangements and relative sizes of roller components, a different number of disks 106 or gussets 110, and other materials do not depart from the scope of this invention.

In view of the above, it will be seen that the several objects of the invention are achieved and other advantageous results obtained.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above without departing from the scope of the invention, it is intended that all matter contained in the above description and shown in the accompanying drawings shall be interpreted as illustrative and not in a limiting sense.

What is claimed is:

1. A gantry press apparatus for assembling a truss, the truss having at least two truss members and at least one connector for connecting the truss members, the apparatus comprising:

a truss table including a worksurface on which said truss members may be positioned;

a roller assembly which is movable relative to the truss table and configured to press said at least one connector into the truss members to join said truss members;

at least one guide for guiding movement of the roller assembly relative to the truss table, the guide extending generally along a side of the table; and a wear strip mounted on the guide and defining a surface engageable by the roller assembly as the roller assembly moves, the wear strip being removably secured to the guide so that the wear strip may be replaced with a different wear strip without replacement of the guide.

2. A gantry press apparatus as set forth in claim 1 wherein there are two guides and two corresponding removable wear strips positioned along opposite sides of the truss table.

3. A gantry press apparatus as set forth in claim 2 wherein each guide comprises a tubular beam having a flat surface for removably mounting the wear strip thereon.

4. A gantry press apparatus as set forth in claim 3 wherein each wear strip comprises a flat, elongate bar.

5. A gantry press apparatus as set forth in claim 4 each wear strip is attached to the guide by at least one bolt fastener.

6. A gantry press apparatus as set forth in claim 3 wherein the roller assembly comprises at least one drive wheel engageable with an upper side of the guide and at least one pressure wheel engageable with a lower side of the guide, and wherein each wear strip is positioned on the lower side of the guide.

7. A gantry press apparatus as set forth in claim 2 wherein the guides are mounted on the sides of the truss table.

8. A gantry press apparatus as set forth in claim 2 wherein the roller apparatus has wheels configured for rolling along said guides, at least two of the wheels on opposite sides of the truss table having generally conical outer side flanges configured for maintaining the roller apparatus in lateral alignment with the table.

9. A gantry press apparatus as set forth in claim 7 wherein each side flange is engageable with a respective one of said wear strips.

* * * * *